US007572411B2

(12) United States Patent
Hall

(10) Patent No.: US 7,572,411 B2
(45) Date of Patent: Aug. 11, 2009

(54) MULTIWELL APPARATUS

(75) Inventor: John P. Hall, Raleigh, NC (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 471 days.

(21) Appl. No.: 11/466,577

(22) Filed: Aug. 23, 2006

(65) Prior Publication Data

US 2006/0280654 A1 Dec. 14, 2006

Related U.S. Application Data

(63) Continuation of application No. 10/108,640, filed on Mar. 29, 2002, now Pat. No. 7,125,522.

(60) Provisional application No. 60/332,735, filed on Nov. 19, 2001.

(51) Int. Cl.
*B01L 3/00* (2006.01)

(52) U.S. Cl. ..... 422/102; 264/511; 269/21; 248/683

(58) Field of Classification Search ..... 422/102; 264/511; 248/683, 689; 269/21
See application file for complete search history.

(56) References Cited

U.S. PATENT DOCUMENTS

| | | | | |
|---|---|---|---|---|
| 3,997,404 | A | | 12/1976 | Waters |
| 4,003,713 | A | | 1/1977 | Bowser |
| 4,657,867 | A | | 4/1987 | Guhl et al. |
| 4,721,679 | A | | 1/1988 | Yiu et al. |
| 5,342,581 | A | | 8/1994 | Sanadi |
| 5,604,130 | A | * | 2/1997 | Warner et al. ..... 435/286.7 |
| 5,817,510 | A | | 10/1998 | Pandey et al. |
| 5,842,573 | A | | 12/1998 | Halvorsen |
| 5,897,838 | A | | 4/1999 | Kempe |
| 5,961,926 | A | | 10/1999 | Kolb et al. |
| 6,450,012 | B1 | | 9/2002 | Mayer et al. |
| 6,485,918 | B1 | | 11/2002 | Schermer et al. |
| 2002/0021986 | A1 | | 2/2002 | McCall et al. |

FOREIGN PATENT DOCUMENTS

| | | |
|---|---|---|
| EP | 0866122 A2 | 9/1998 |
| EP | 1192995 A2 | 4/2002 |
| WO | WO 95/20527 | 8/1995 |
| WO | WO 02/49760 | 6/2002 |

* cited by examiner

*Primary Examiner*—Jill Warden
*Assistant Examiner*—Natalia Levkovich
(74) *Attorney, Agent, or Firm*—Hoffmann & Baron, LLP

(57) ABSTRACT

A method for assembling a multiwell plate assembly, and a multiwell plate assembly prepared thereby, are provided. The method includes providing a lid for a multiwell plate body having at least one channel being formed therethrough; positioning the lid in proximity to a gasket member; applying sufficient negative pressure to the channel to draw the gasket member towards the lid; positioning the lid above a multiwell plate body, while continuing to apply negative pressure to the channel; emplacing the lid on the multiwell plate body; and, releasing the negative pressure from the channel. Advantageously, as will be recognized by those skilled in the art, various gasket members can be used in conjunction with the subject method, without altering the method. In this manner, gaskets can be selected based on their suitability for use with various biological and/or chemical samples which may be used in the bioassays.

8 Claims, 9 Drawing Sheets

MULTIWELL APPARATUS

CROSS REFERENCES TO RELATED APPLICATIONS

This application is a continuation of U.S. application Ser. No. 10/108,640, filed Mar. 29, 2002, now allowed, which claims priority of U.S. Provisional Patent Application No. 60/332,735, filed Nov. 19, 2001, the contents of which are incorporated by reference herein.

FIELD OF THE INVENTION

This invention relates to multiwell plate assemblies and methods for assembling multiwell assemblies and, more particularly, to methods of sealing multiwell plate assemblies.

BACKGROUND OF THE INVENTION

Multiwell plate assemblies are known in the prior art which are commonly used for bioassays. Each multiwell plate assembly includes a multiwell plate body having an array of wells formed therein, typically having 96, 384, or 1,536 wells. Because of the commonplace use of multiwell plate bodies, standard dimensions of the plates have been developed to facilitate use with pick-and-place machines. Each well is cup-shaped and accommodates various chemical and/or biological fluids and matters in conducting parallel bioassays, such as with parallel drug screening.

In certain instances. it is desired to minimize, if not prevent, contamination of the bioassays from external sources, as well as, intermixing of the fluids/matters of the various wells. To this end, various techniques have been developed to seal the wells, including providing an emplaceable lid atop the multiwell plate body, and/or adhering a thin film across the open ends of the wells. These prior art techniques, however, suffer from several drawbacks, including having an excessively-loose seal provided by the emplaceable lid, and/or requiring adhesion of a film.

SUMMARY OF THE INVENTION

To overcome deficiencies of the prior art, a method for assembling a multiwell plate assembly, and a multiwell plate assembly prepared thereby, are provided. The method includes providing a lid for a multiwell plate body having at least one channel being formed therethrough; positioning the lid in proximity to a gasket member; applying sufficient negative pressure to the channel to draw the gasket member towards the lid; positioning the lid above a multiwell plate body, while continuing to apply negative pressure to the channel; emplacing the lid on the multiwell plate body; and, releasing the negative pressure from the channel. Advantageously, as will be recognized by those skilled in the art, various gasket members can be used in conjunction with the subject method, without altering the method. In this manner, gaskets can be selected based on their suitability for use with various biological and/or chemical samples which may be used in the bioassays.

In addition, the multiwell plate body may be formed with latchable members which may be formed to engage the multiwell plate body. As such, the lid may be formed to tightly latch onto the multiwell plate body and provide a compressive force against the gasket, thereby causing the gasket to form a tight seal with the multiwell plate body, without being adhered thereto. Preferably, the gasket is resilient, and may be formed of one or more layers, depending on the necessary sealing characteristics. The lid may be moved using any technique known to those skilled in the art.

In another aspect of the invention, a vacuum may also be applied to the lid to allow the lid to be lifted and maneuvered separately, or together with, the gasket.

These and other features of the invention will be better understood through a study of the following detailed description and accompanying drawings.

DETAILED DESCRIPTION OF THE INVENTION

Figure 1:
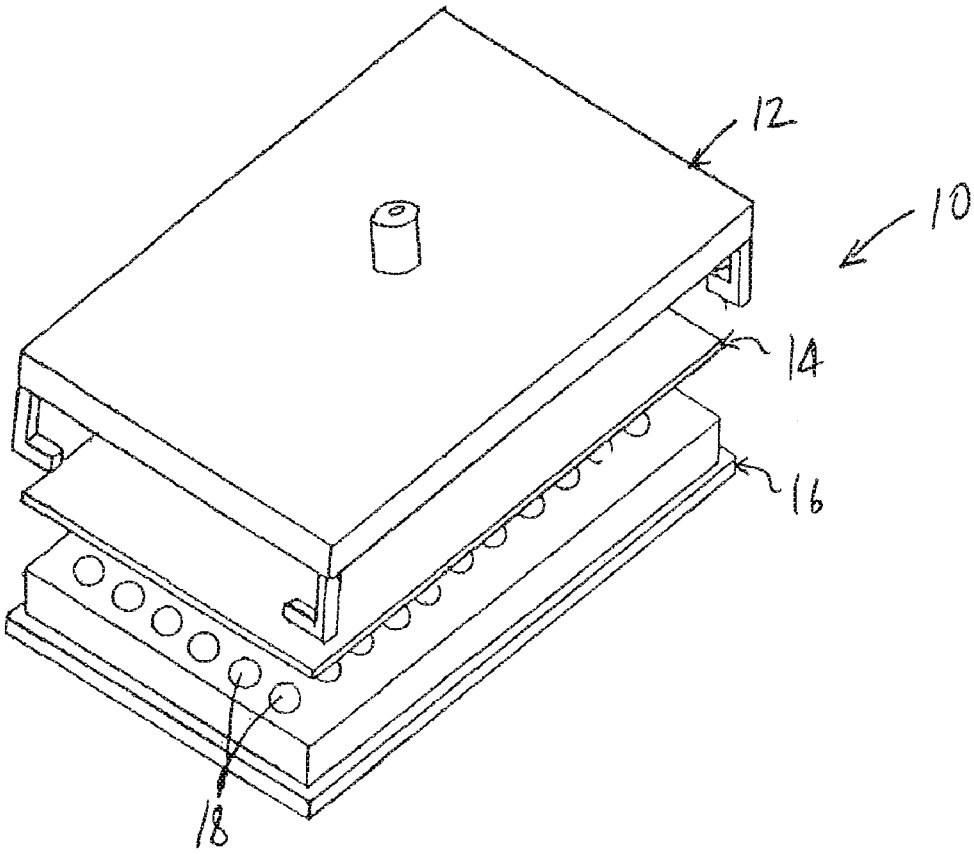
FIG. 1 is an exploded perspective view of a multiwell plate assembly having a lid formed in accordance with a first embodiment of the subject inventions

With reference to FIGS. 1-7, a first embodiment of the subject invention is depicted wherein a multiwell plate assembly 10 is prepared. The multiwell plate assembly 10 includes a lid 12, a gasket member 14, and a multiwell plate body 16. The multiwell plate body 16 is formed in accordance with conventional principles, wherein all array of wells 18 are defined therein. The dimensions of the multiwell plate body 16 are such so that the multiwell plate body 16 is usable with known pick-and-place machines.

Figure 2:
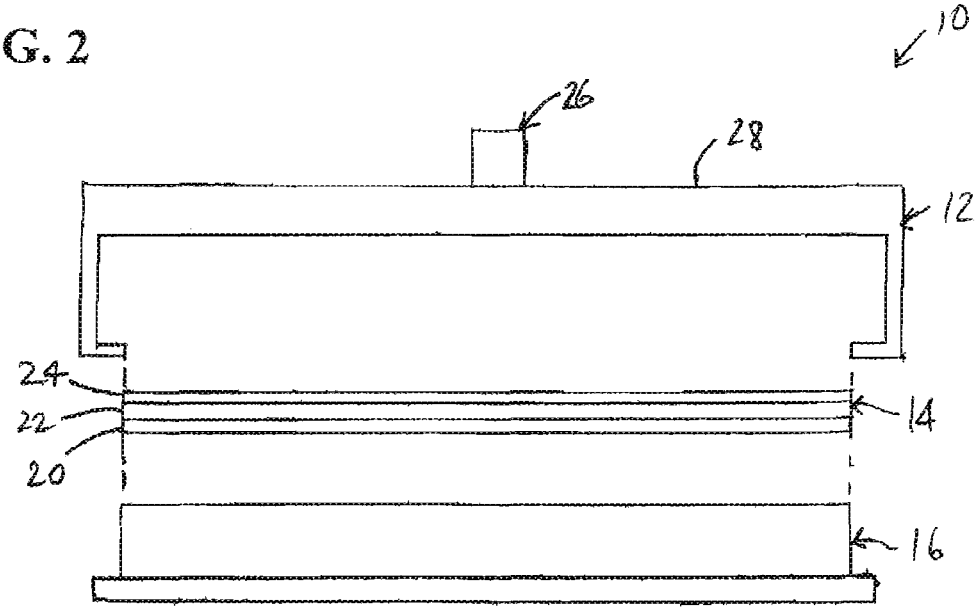
FIG. 2 is an exploded side view of the assembly of FIG. 1.

The gasket member 14 is preferably resilient and may be formed of one or more layers. The selection of the constituent material(s) for the layer(s) of the gasket member 14 may be selected based on the material's suitability for use with the biological and/or chemical substances which may be disposed within the wells 18 of the multiwell plate body 16. With reference to FIG. 2, by way of non-limiting example, the gasket member 14 may have three layers 20, 22, 24, with one or more of the layers 20-24 being resilient, and/or having good sealing and/or barrier (e.g., moisture; gas) properties.

Any gasket material known to those skilled in the art which is suitable for use with bioassays may be utilized in the gasket member 14.

Figure 3:
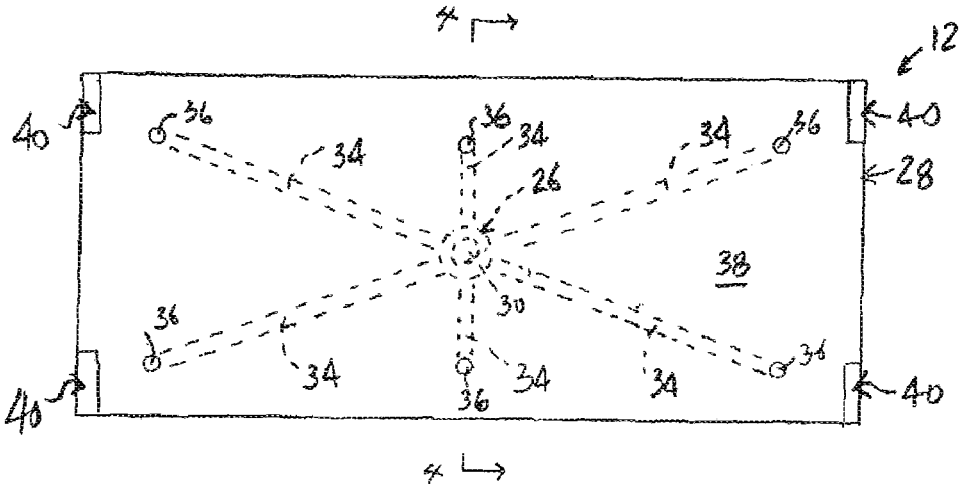
FIG. 3 is a bottom view of the lid shown in FIG. 1.
Figure 4:
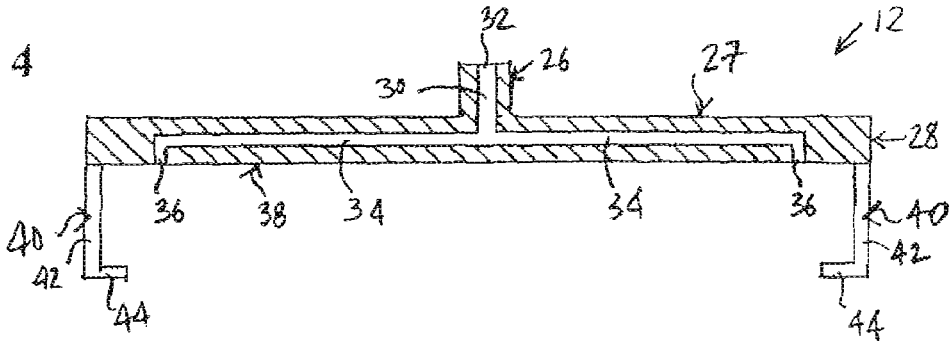
FIG. 4 is a cross-sectional view taken along line 4-4 of FIG. 3.

As described below, the hid 12 may be formed in various manners. FIGS. 1-7 depict a first embodiment of the lid 12, wherein a boss 26 extends upwardly from a top surface 27 of a top 28 of the lid 12. As best shown in FIGS. 3 and 4, a channel 30 extends from an opening 32 formed at an end of the boss 236, with the channel 30 coming into communication with a plurality of secondary channels 34 that extend through the top 28 and terminate at openings 36 formed in a lower surface 38 of the top 28.

In a preferred embodiment, latchable members 40 extend from the lower surface 38 which are formed to engage, and latch onto, the multiwell plate body 16. Each of the latchable members 40 includes a deflectable, downwardly-extending arm 42 which terminates at an inwardly-extending tab 44, with this configuration generally defining a L-shape. Preferably, the latchable members 40 are integrally formed with the lid 12 and formed of a resilient material, preferably a thermoplastic. A sufficient number of the latchable members 40 is provided to facilitate tight latching of the lid 12 onto the multiwell plate body 16. In a preferred arrangement, each of the corners of the lid 12 is provided with one of the latchable members 40 to generate a perimetric holding force.

Figure 5:
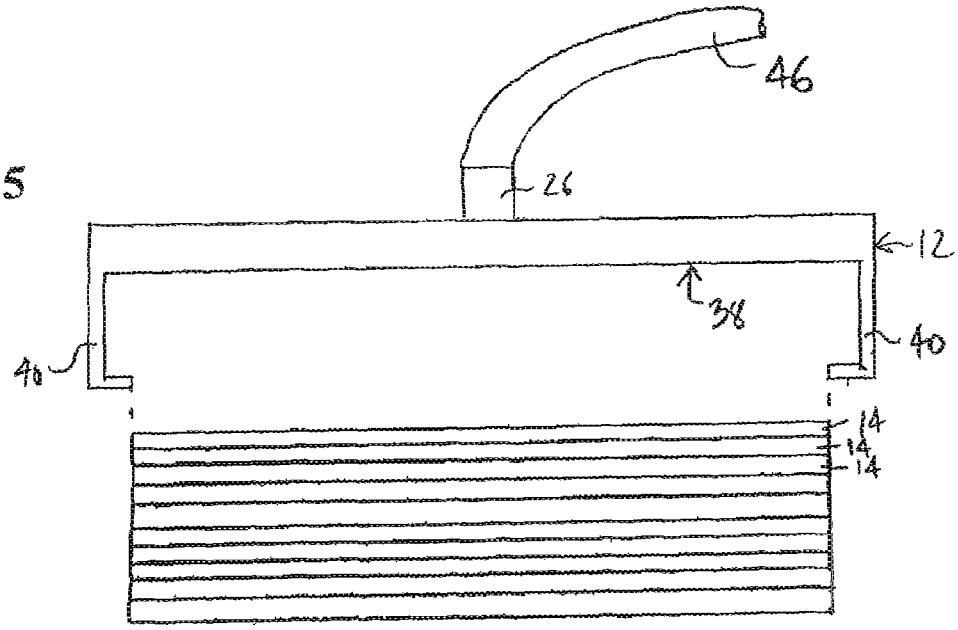
FIG. 5 shows the lid of FIG. 1 being connected to a source of negative pressure with the lid being positioned in proximity to a plurality of gasket members.
Figure 6:
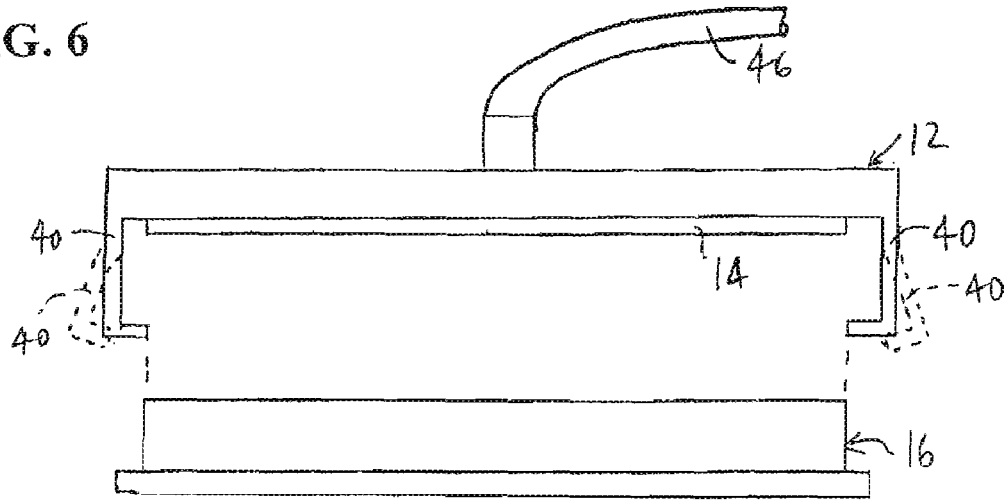
FIG. 6 shows a gasket member being maintained on the lid due to negative pressure, with the lid being positioned in proximity to a multiwell plate body.
Figure 7:
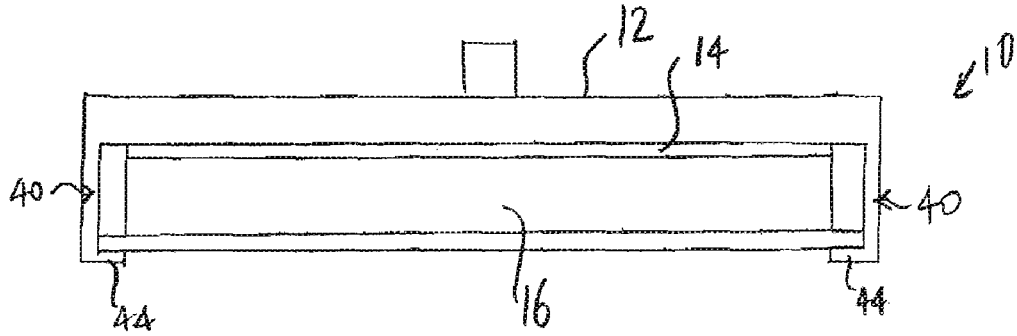
FIG. 7 is a side view of an assembled multiwell plate assembly with the components shown in FIG. 1.

With reference to FIGS. 5-7, the method of preparing the multiwell plate assembly 10 is depicted therein. As shown in FIG. 5, in a first step, a source of negative pressure (such as a hose) 46 is connected to the boss 26, and the lid 12 is positioned in proximity to a supply of the gasket members 14. It is preferred that inner dimensions defined by the latchable members 40 be selected so as to permit passage therethrough of the gasket members 14. Sufficient negative pressure is applied such that one of the gasket members 14 is drawn towards the lower surface 38 of the lid 12, and preferably drawn into abutting contact therewith. The negative pressure is applied through the channel 30 and the secondary channels 34 to preferably engage the gasket member 14 at multiple locations via the openings 36. The openings 36 are positioned to facilitate a generally even application of the negative pressure.

With the application of negative pressure being maintained, the lid 12 is positioned above the multiwell plate body 16 (FIG. 6), and relative movement therebetween is generated such that the latchable members 40 latch onto the bottom of the multiwell plate body 16, as shown in FIG. 7. The movement of the lid 12 may be achieved through any technique known to those skilled in the art, including a pick-and-place apparatus. To allow for mounting of the lid 1.2 onto the multiwell plate body 16, the latchable members 40 may be caused to deflect outwardly (as shown in dashed lines in FIG. 6) through contact with the multiwell plate body 16, or be deflected outwardly by a guide or tool (not shown).

In an assembled state, the lid 12 and the multiwell plate body 16 encompass a volume therebetween in which the gasket member 14 resides. Preferably, the gasket member 14 is maintained in at least a partially compressed state to provide a tight seal for the multiwell plate assembly 10. As is readily apparent, the subject invention can be used in an automated technique for assembling multiwell plate assemblies, where the specific type of gasket may be readily changed during the assembly procedure.

Figure 8:
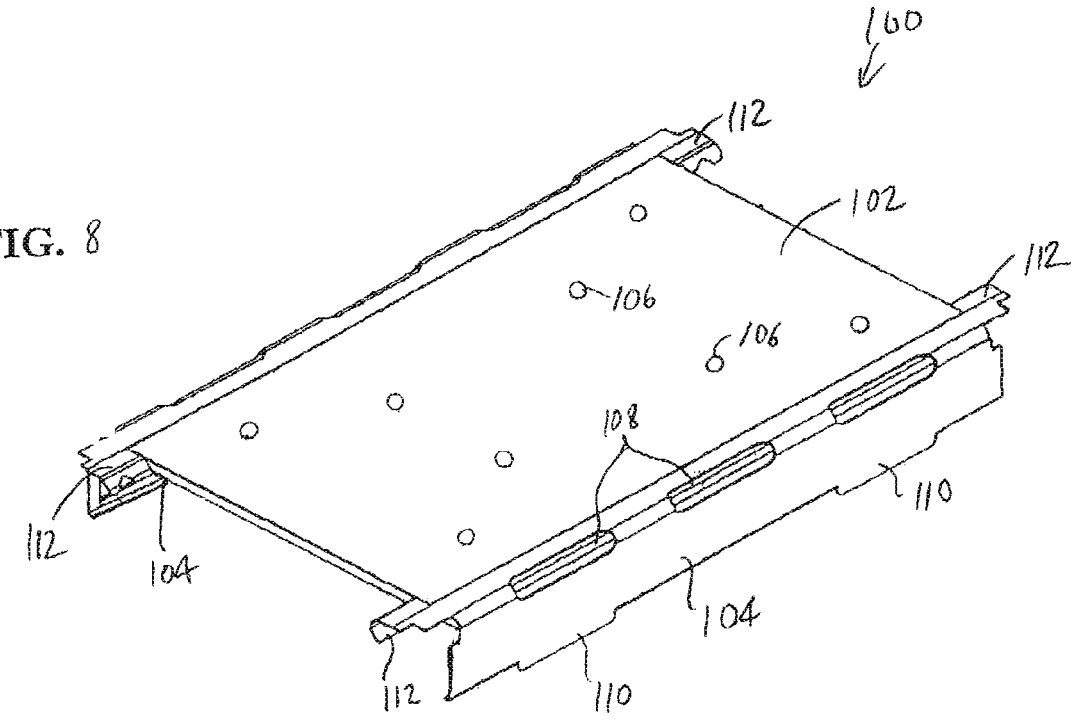
FIG. 8 shows a second embodiment of a lid utilizable with the subject invention.

With reference to FIG. 8, a second embodiment of the lid utilizable with the subject invention is depicted therein and generally designated with the reference numeral 100. The lid 100 includes a top portion 102 and downwardly extending sides 104. Channels 106 are defined through the top 102 at various locations thereabout. Preferably, the channels 106 are straight holes formed through the top portion 102.

The sides 104 are outwardly deflectable in the same manner as the deflectable members 40 described above, so as to allow for latching onto a multiwell plate body. Relief apertures 108 may be provided to enhance the deflectability of the sides 104. Lower lips 110 extend from the bottom edges of the sides 104 inwardly and are shaped and configured to latch onto the bottom of a multiwell plate body. Depending on the method used to handle the lid 100, one or more tabs 112 may be provided which extend from the top portion 102.

Figure 9:
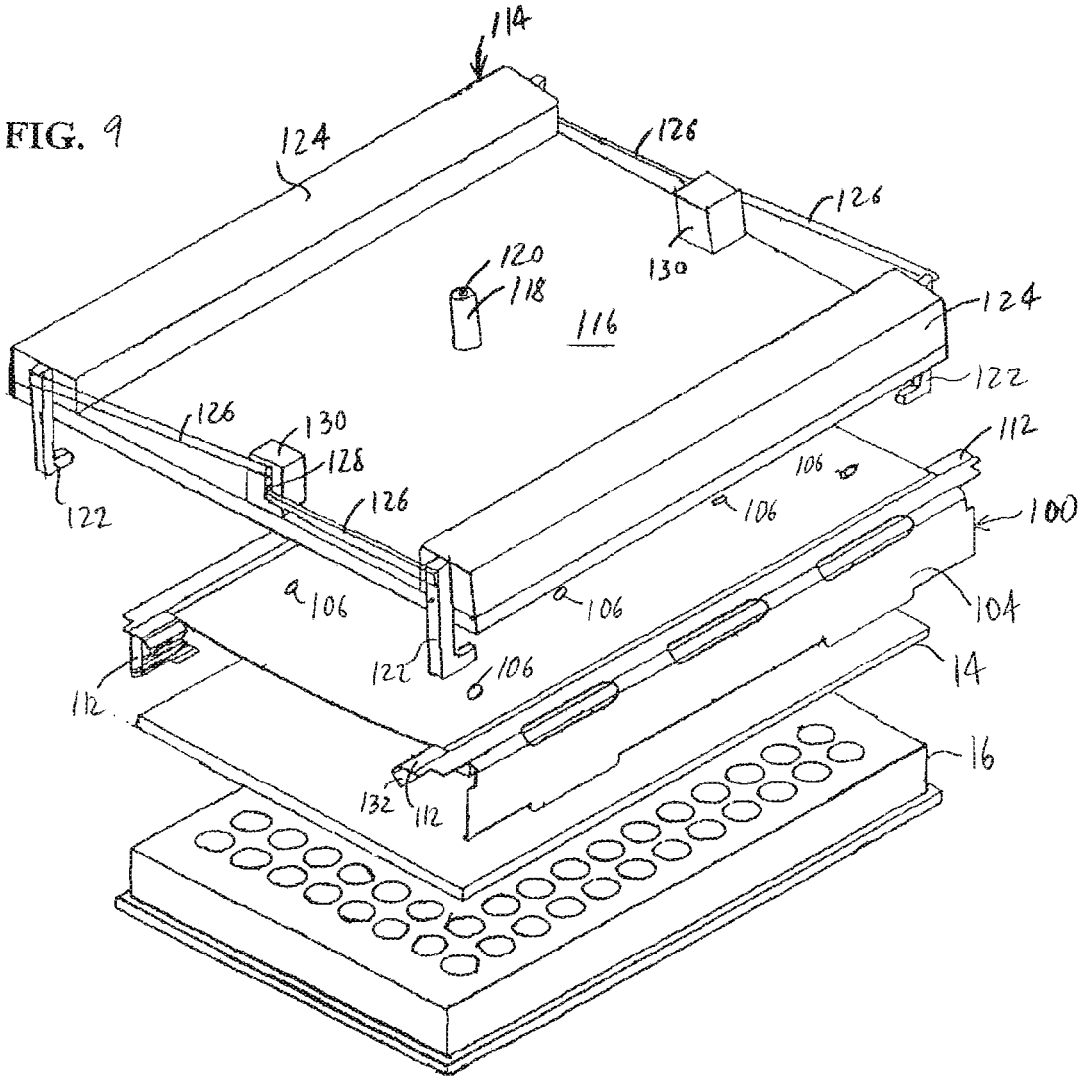
FIG. 9 is an exploded perspective view showing a carrier for maneuvering the lid of FIG. 8.
Figure 10A:
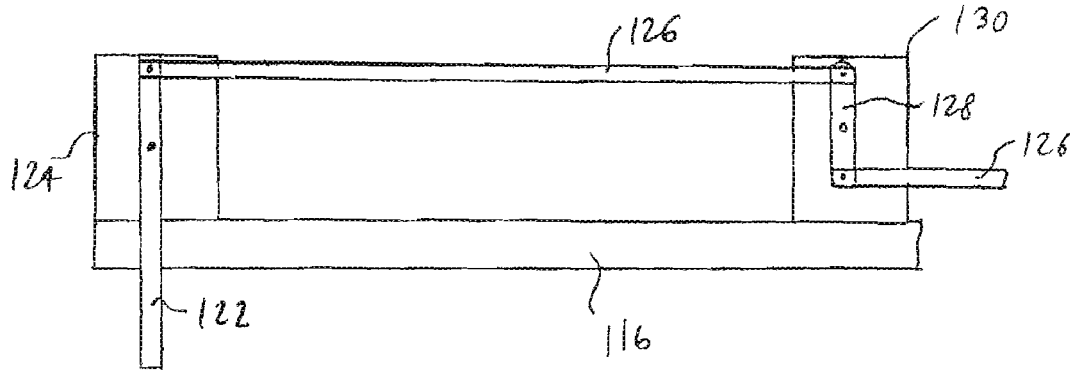
FIGS. 10A and 10B, respectively, show schematically actuation of the carrier.
Figure 10B:
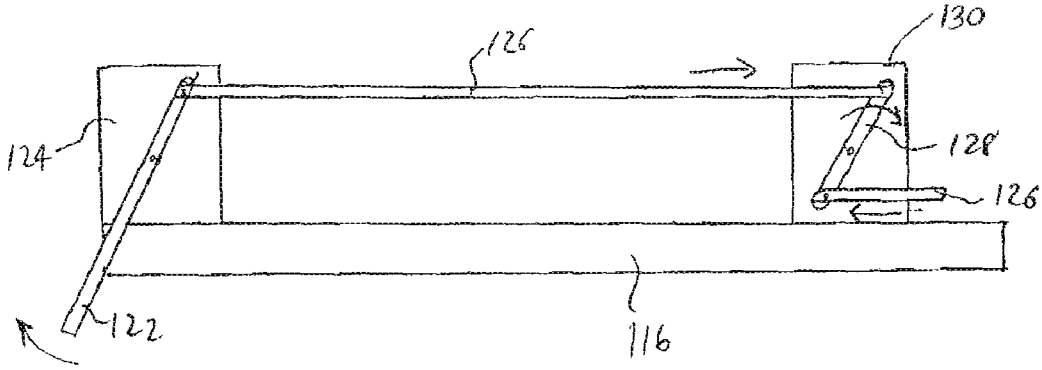

With reference to FIGS. 9, 10*a* and 10*b*, an apparatus 114 is shown for maneuvering the lid 100 in preparing a multiwell plate assembly. The apparatus 114 includes a plate 116 from which extends a boss 118. A channel 120 is formed to extend through the boss 118 and through the plate 116. L-shaped members 122 are pivotally mounted to support blocks 124 affixed to the plate 116. The L-shaped members are positioned and shaped to slip under the tabs 112 of the lid 100 in providing support thereof in movement. Linkages 126 are rigidly connected to each of the L-shaped members 122 and to a control link 128 pivotally mounted to a control block 130. As shown in FIGS. 10*a* and 10*b*, upon rotation of the control link 128, the linkages 126 are displaced, thereby causing the L-shaped members 122 to pivot and be radially displaced outwardly. As such, the L-shaped members 122 can be manipulated to be positioned below the tabs 112. Preferably, the tabs 112 have inner edges 132 which limit excessive inward movement of the L-shaped members 122, with outward movement thereof being unobstructed.

Again, with reference to FIG. 9, the apparatus 114 may be positioned above the lid 100 and caused to lift the lid 100 with selective placement of the L-shaped members 122 below the tabs 112. Thereafter, negative pressure may be introduced through the channel 120, and through the channels 106 in the lid 100, to draw a gasket member 14 towards the lid 100, and preferably into contact therewith. Thereafter, the lid 100 may be positioned above a multiwell plate body 16 with the lid 100 having its sides 104 latched thereonto. The application of the negative pressure through the channel 120 is then discontinued, and the L-shaped members 122 are caused to displace radially to allow for the apparatus 114 to separate from the lid 100.

Figure 11:
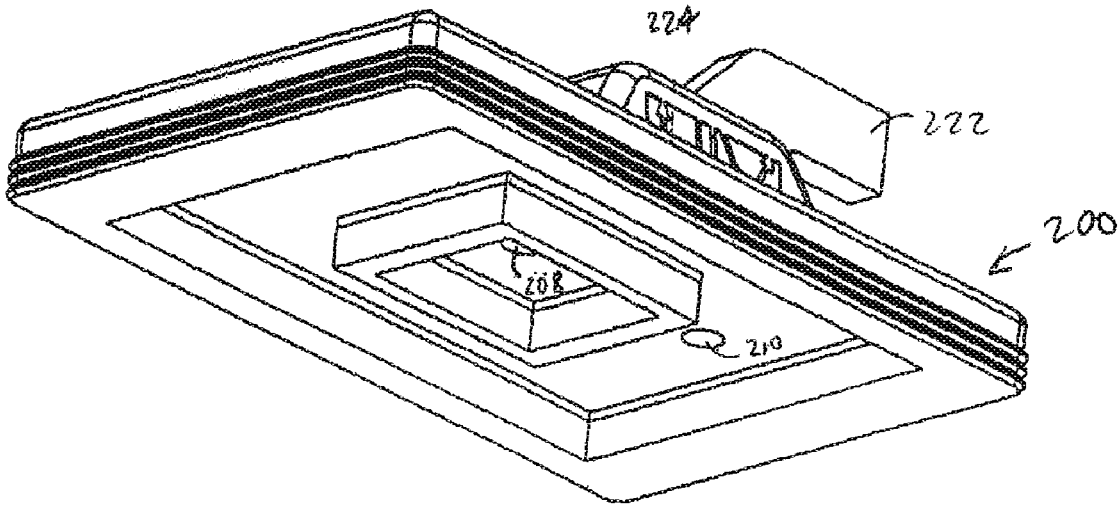
FIG. 11 is a lower perspective view of a vacuum pick apparatus for use with the embodiment of the lid shown in FIG. 8.
Figure 12:
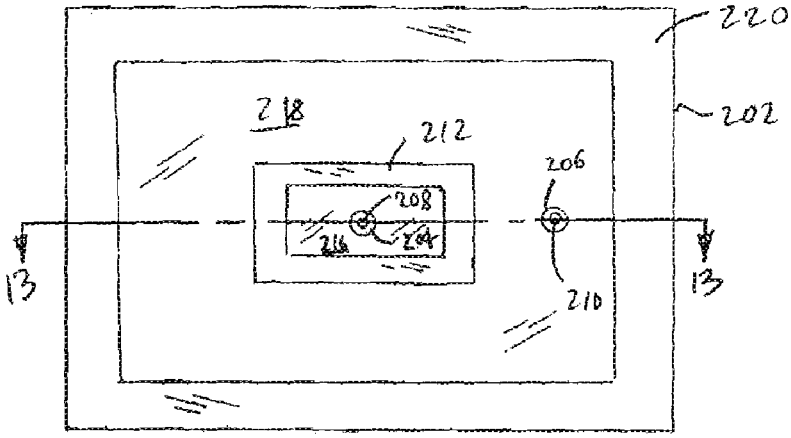
FIG. 12 is a bottom plan view of the vacuum pick apparatus.
Figure 13:
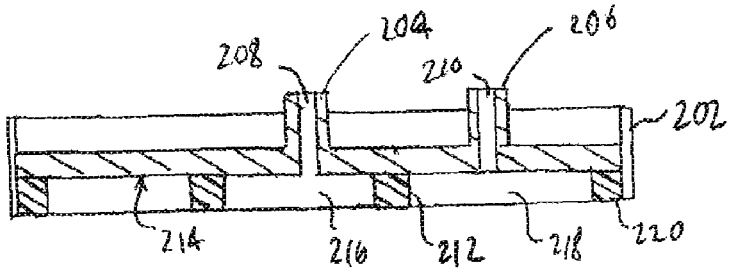
FIG. 13 is a cross-sectional view of the vacuum pick apparatus taken along line 13-13 of FIG. 12.

With reference to FIGS. 11-14, a vacuum pick apparatus 200 is shown which may be used to maneuver the lid 100 along with a gasket 14. Referring to FIGS. 11-13, the apparatus 200 includes a plate portion 202 from which extend a first boss 204 and a second boss 206 having channels 208 and 210, respectively, extending therethrough and through the plate 202. A separating member 212, preferably resilient, is mounted to a lower surface 214 of the plate 202 so as to bound the channel 208. The area bounded within the separating member 212 constitutes a first zone 216, whereas, the area beyond the separating member 212 constitutes a second zone 218. A sealing member 220, preferably resilient, may be provided that bounds the outer perimeter of the second zone 218. As best shown in FIG. 13, the first zone 216 is in communication with the channel 208, and the second zone 218 is in communication with the channel 210. By connecting separate sources of negative pressure to the bosses 204 and 206, negative pressure within the first zone 216 can be controlled independently from the second zone 218. As shown in FIG. 11, the two sources can be connected through a common conduit 222 which passes through a hood 224 with separate lines being fixed to the bosses 204 and 206.

Figure 14:
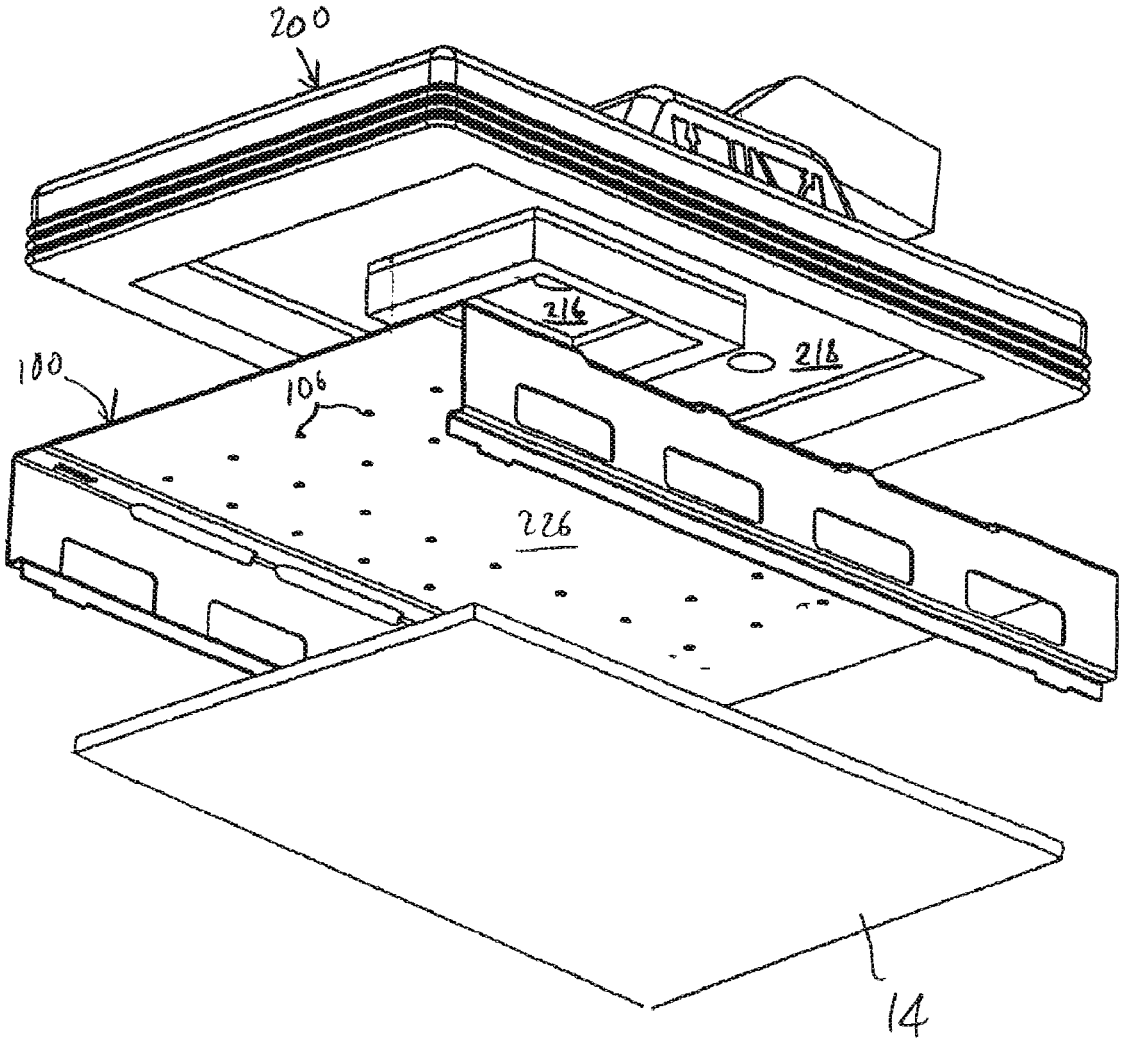
FIG. 14 is an exploded perspective view showing a gasket member together with the lid of the second embodiment and the vacuum pick apparatus; and, FIG. 15 is an exploded perspective view showing a third embodiment of a lid utilizable with the subject invention having a top portion shaped convexly inwardly.

Referring to FIG. 14, the apparatus 200 may be used to maneuver the lid 100 of the second embodiment of the subject invention. For optimum performance with the apparatus 200, it is preferred that the channels 106 be formed in the lid 100 so as to define an intact engaging surface 226 dimensioned larger than the first zone 216. Accordingly, in use, the apparatus 200 may be positioned above the lid 100 and negative pressure may be applied to the first zone 216 which can act on the engaging surface 226 and cause the lid 100 to be drawn to the apparatus 200. Separately, negative pressure may be applied to the second zone 218 which passes through the channels 106 to draw any gasket member 14 towards the lid 100. The gasket 14 and the lid 100 can be selectively lifted in this manner by the apparatus 200. As can be seen in FIG. 14, the tabs 112 need not be provided on the lid 100, such as, for example, when used with the apparatus 200.

Figure 15:
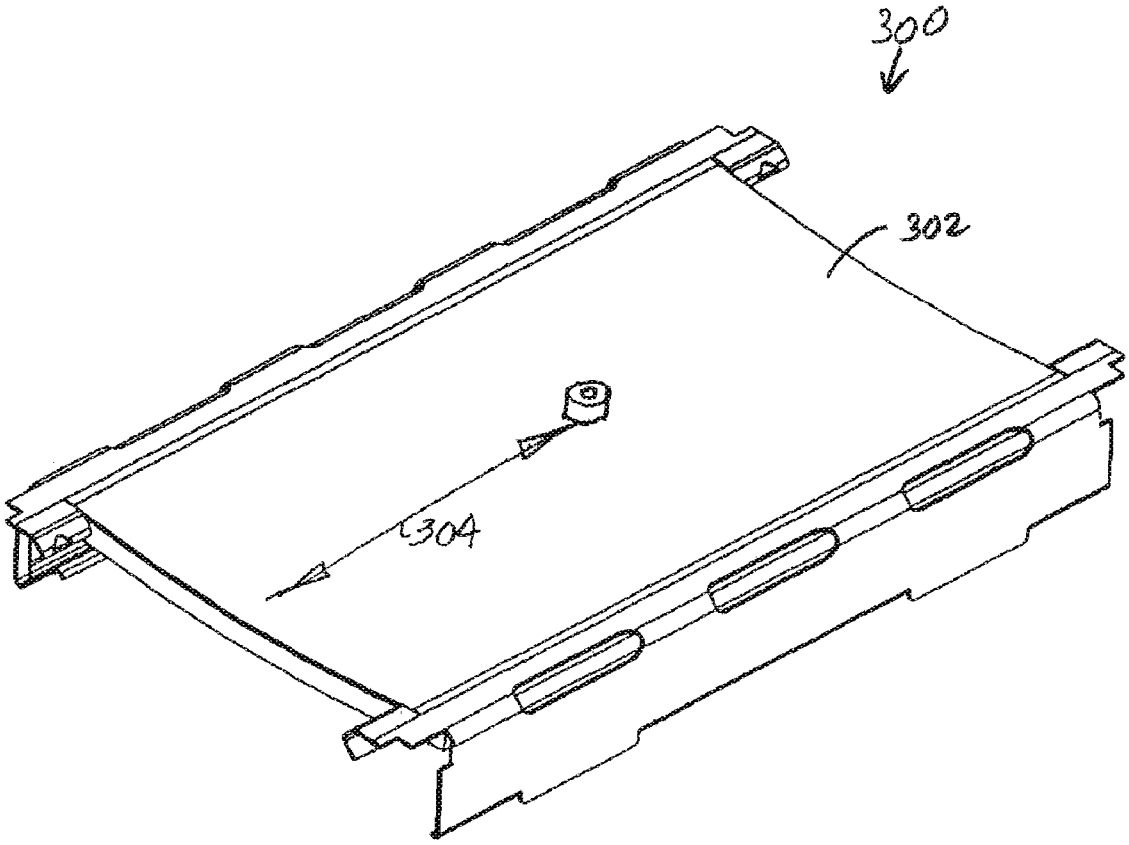

A third embodiment of a lid utilizable with the subject invention is depicted in FIG. 15 and designated with the reference numeral 300. The lid 300 may be formed as the lid 12 or the lid 100 described above, but with a top portion 302 which is shaped convexly downwardly in a natural state. The top portion 302 may be shaped convexly downwardly along its longitudinal axis 304, in a direction transverse to the longitudinal axis 304, or a combination thereof. Accordingly, upon latching the lid 300 onto a multiwell plate body, the top portion 302 becomes stressed, thereby providing additional holding force for pressing against a gasket member in generating a better seal with a multi well plate body.

Various changes and modifications can be made in the present invention. It is intended that all such changes and modifications come within the scope of the invention as set forth in the following claims.

What is claimed is:

1. A method of assembling a multiwell plate assembly, said method comprising:

providing a lid having at least one channel being formed therethrough;

positioning said lid in proximity to a gasket member with said at least one channel oriented towards said gasket member;

providing a source of negative pressure with at least one controller;

positioning a vacuum pick apparatus above said lid, wherein said vacuum pick apparatus is partitioned into at least first and second zones, negative pressure being generated in said first and second zones being separately controlled;

applying sufficient negative pressure from said source of negative pressure to said at least one channel via said first zone of said vacuum pick apparatus to draw said gasket member towards said lid;

positioning said lid above a multiwell plate body having a plurality of wells defined therein, while continuing to apply negative pressure to said at least one channel;

emplacing said lid on said multiwell plate body; and, releasing the negative pressure from said at least one channel.

2. A method as in claim 1, wherein said lid is formed solid below said second zone so that said second zone may selectively apply negative pressure to said solid portions of said lid formed below said second zone.

3. A method as in claim 1, wherein said emplacing includes latching latchable members formed on said lid onto said multiwell plate body.

4. A method as in claim 1, wherein said lid includes a top portion, said at least one channel being defined in said top portion, wherein said top portion being shaped convexly downwardly in a natural state such that said top portion becomes stressed upon said lid being emplaced on said multiwell plate body.

5. A method of assembling a multiwell plate assembly, said method comprising:

providing a lid having at least one channel being formed therethrough, wherein said lid includes a top portion, said at least one channel being defined in said top portion, said top portion being shaped convexly downwardly in a natural state;

positioning said lid in proximity to a gasket member with said at least one channel oriented towards said gasket member;

providing a source of negative pressure with at least one controller;

applying sufficient negative pressure from said source of negative pressure to said at least one channel to draw said gasket member towards said lid;

applying a negative pressure to said lid, wherein said negative pressure applied to said lid is separately controlled from said negative pressure applied to said at least one channel;

positioning said lid above a multiwell plate body having a plurality of wells defined therein, while continuing to apply negative pressure to said at least one channel;

emplacing said lid on said multiwell plate body with said top portion becoming stressed; and, releasing the negative pressure from said at least one channel.

6. A method as in claim 5, wherein said emplacing includes latching latchable members formed on said lid onto said multiwell plate body.

7. A method of assembling a multiwell plate assembly, said method comprising:

providing a lid having at least one channel being formed therethrough;

positioning said lid in proximity to a gasket member with said at least one channel oriented towards said gasket member;

providing a source of negative pressure with at least one controller;

applying sufficient negative pressure from said source of negative pressure to said at least one channel to draw said gasket member towards said lid;

applying negative pressure to said lid, wherein said negative pressure applied to said lid is separately controlled from said negative pressure applied to said at least one channel;

positioning said lid above a multiwell plate body having a plurality of wells defined therein, while continuing to apply negative pressure to said at least one channel;

emplacing said lid on said multiwell plate body;

releasing the negative pressure from said lid; and, releasing the negative pressure from said at least one channel.

8. A method as in claim 7, wherein said emplacing includes latching latchable members formed on said lid onto said multiwell plate body.

* * * * *